US006285961B1

(12) United States Patent
Jahkonen et al.

(10) Patent No.: US 6,285,961 B1
(45) Date of Patent: Sep. 4, 2001

(54) PROCEDURE FOR DETERMINING THE PARAMETERS FOR AN ELECTRIC DRIVE CONTROLLING A SYNCHRONOUS ELEVATOR MOTOR WITH PERMANENT MAGNETS

(75) Inventors: Pekka Jahkonen, Helsinki; Tapio Saarikoski, Hyvinkaa, both of (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/194,781

(22) PCT Filed: Apr. 3, 1998

(86) PCT No.: PCT/FI98/00297

§ 371 Date: Feb. 3, 1999

§ 102(e) Date: Feb. 3, 1999

(87) PCT Pub. No.: WO98/47806

PCT Pub. Date: Oct. 29, 1998

(30) Foreign Application Priority Data

Apr. 4, 1997 (FI) ..... 971421

(51) Int. Cl.[7] ..... B66B 1/30

(52) U.S. Cl. ..... 702/115; 187/318

(58) Field of Search ..... 702/115, 65; 187/277, 187/294, 295, 296, 318; 324/207.2, 545, 772; 310/166, 162; 318/727, 433

(56) References Cited

U.S. PATENT DOCUMENTS 4,446,946 * 5/1984 Kajiyama et al. ..... 187/29
4,779,709 * 10/1988 Mitsui et al. ..... 187/119
5,388,052 2/1995 Mann ..... 702/65
5,420,523 * 5/1995 Walker et al. ..... 324/772

FOREIGN PATENT DOCUMENTS 0638988 2/1992 (EP) .

* cited by examiner

*Primary Examiner*—Patrick Assouad
*Assistant Examiner*—Edward Raymond

(57) ABSTRACT

A procedure determines the parameters for an electric drive that controls a synchronous elevator motor having permanent magnets, a computer controlling the operation of the electric drive being provided with a control model describing the elevator and containing settable parameters. To determine electric drive parameters, an elevator car installed in the elevator shaft is allowed to enter a motional condition produced by the balance difference between the elevator masses using two different loads connected to the terminals of the synchronous motor, the rotational speed, electromotive force and synchronous reactance of the synchronous motor are measured while the elevator car is in a constant motional condition, and the stator resistance is measured via a separate measure. A control model describing the elevator is computed and formed from these measurements.

11 Claims, 1 Drawing Sheet

PROCEDURE FOR DETERMINING THE PARAMETERS FOR AN ELECTRIC DRIVE CONTROLLING A SYNCHRONOUS ELEVATOR MOTOR WITH PERMANENT MAGNETS

This application is the national phase under 35 U.S.C. §371 of prior PCT International Application No. PCT/FI98/00297 which has an International filing date of Apr. 3, 1998 which designated the United States of America.

BACKGROUND OF THE INVENTION

1. Field of the Invention

The present invention relates to a procedure for determining the parameters of an electric drive that controls a synchronous elevator motor having permanent magnets.

2. Description of Related Art

Several methods and calculation programs have been developed to allow the adjustments of a converter used in elevator control to be made at the factory. Generally, the converter settings are calculated based on the motor and elevator data specified in a customer's order. Such calculations may be done relatively long before the elevator is actually delivered and installed in the shaft. Problems exist, however, due to the inaccuracy and divergence of both elevator data and motor data. The parameters describing the motor are usually given as typical values. These so-called name plate values may differ from the actual properties of the motor by several percentage units. When the frequency converter has been adjusted based on typical values, both the frequency converter and the elevator need additional adjustment at the site of installation. Adjustments carried out at the site of installation increase the installation time, thus increasing the total manufacturing and installation costs of the elevator.

Recently, a new type of synchronous motor with permanent magnets, described in international patent application WO 95/00432, has been developed for use in elevator drives. Although the use of this new motor type as an elevator component brings considerable advantages, as a consequence of the large diameter and discoid shape of its rotor/stator, certain manufacturing tolerances must have larger values. This in turn leads to a larger range of variation in the performance characteristics of the manufactured motors than in the case of conventional asynchronous motors. As this new type of elevator motor generally forms an integral part of the hoisting machinery of the elevator, the installation assembly containing the motor is relatively heavy, so it is difficult to handle, move or mount on a test bench. This makes it still more difficult to adjust the frequency converters in factory.

An object of the present invention is to eliminate the drawbacks mentioned above. A specific object of the invention is to provide a new type of method by which the parameters for the electric drive of previously-installed elevator can be determined and set as simply, quickly and economically as possible.

SUMMARY OF THE INVENTION

The procedure of the invention is based on an arrangement in which the elevator car is installed in the elevator shaft before any precise adjustments are made, so that adjustments are carried out under actual operating conditions of the elevator. According to the invention, after the elevator car has been installed in the elevator shaft, the car is allowed to move freely as driven by the forces resulting from the elevator masses, mainly from the imbalance between the masses of the elevator car and counterweight. Once the elevator car has reached a constant motion condition, the rotational speed, electromotive force and synchronous reactance of the synchronous motor are measured for two different loads connected to the terminals of the synchronous motor. In addition, a separate measurement is carried out to determine the stator resistance. From these measurements, an actual control model describing the elevator is then calculated and formed.

The two measurements are preferably performed using previously-provided connections in the motor. Thus, one of the measurements can be carried out with a normal braking resistance connected to the motor terminals and the other with the motor short-circuited. However, other loads can also be used in the measurements.

The measurements to be made in a constant motional condition are preferably carried out separately, i.e. first a given connection is made between the motor terminals, whereupon the first measurement is carried out. After this, the connection is changed and the second measurement is carried out. In a particularly preferred case, the elevator is allowed to enter a free motional condition from the same point in the elevator shaft and the measurements are performed at the same place in the elevator shaft while the elevator is in a constant motional condition. This allows any variations in the friction between the elevator car and the elevator shaft to be eliminated from the measurements. However, it is also possible to carry out the measurements during a single free motional condition of the elevator car by changing the connection while the car is moving.

The stator resistance can be determined beforehand with relatively good accuracy and stored in the memory of the computer controlling the frequency converter. On the other hand, stator resistance can also be measured, for example, by means of the current sensor of the frequency converter using direct current.

The procedure of the present invention has significant advantages as compared with the prior art. The procedure allows simpler processes in the manufacture of the elevator machinery and in elevator delivery. Larger divergences are permitted in the parameters of the elevator machinery than traditionally. Alternatively, the testing of the machinery can be simplified. In the elevator delivery process, the amounts of calculations and factory settings as well as documentation can be reduced. Reliability of the elevator is increased and its operating characteristics are improved because the adjustment values of the system are in better accordance with the particular machinery and elevator shaft.

Significant advantages may also be gained by applying the procedure of the present invention in conjunction with regular maintenance of the elevator. The characteristics of the frequency converter can thus be easily modified in accordance with the changes in mechanical properties caused by ageing or wear of the elevator. By adjusting the parameters, the elevator can also be adapted for optimal operation in situations involving various changes in external conditions. Such changes may be caused by such factors as seasonal variations in temperature and humidity, which occur in most buildings in spite of or due to heating or cooling.

BRIEF DESCRIPTION OF THE DRAWINGS

The invention will be described in detail by referring to the attached drawings, in which.

DETAILED DESCRIPTION

Figure 1:
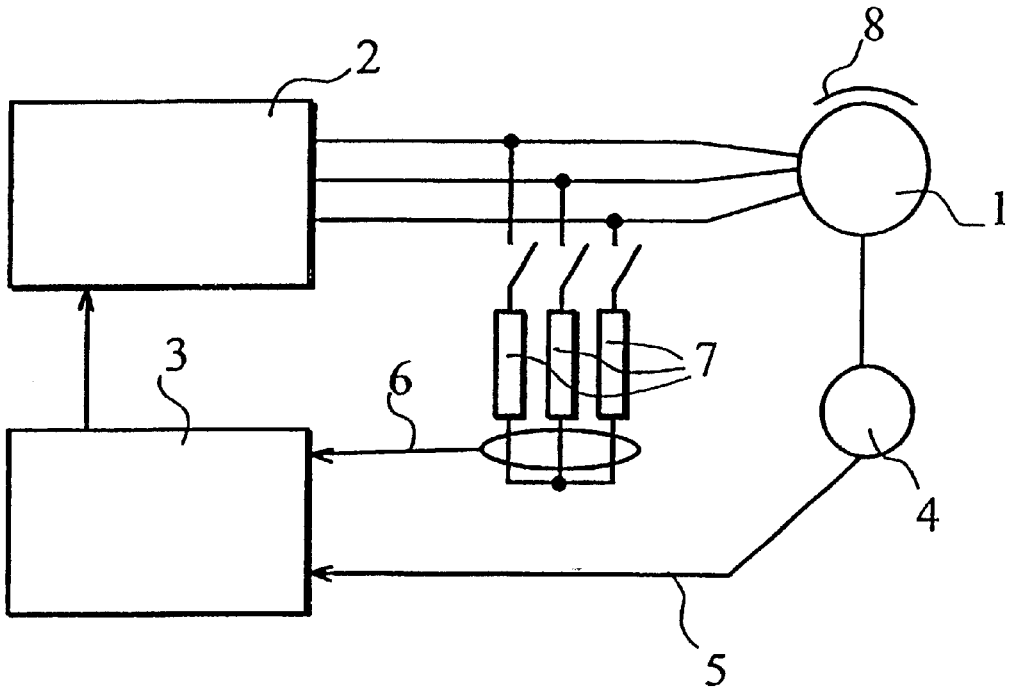
FIG. 1 is a schematic representation of a system in which the procedure of the invention is used.

The procedure of the invention can be used e.g. in a system as illustrated by FIG. 1. In this system, the elevator motor 1 is operated using a frequency converter drive 2 controlled by a control computer 3. The control computer 3 receives from a tachometer 4 a speed signal 5 representing the rotational speed of the motor. Another control signal supplied to the control computer 3 is a current feedback signal 6 obtained from the braking resisters 7.

Figure 2:
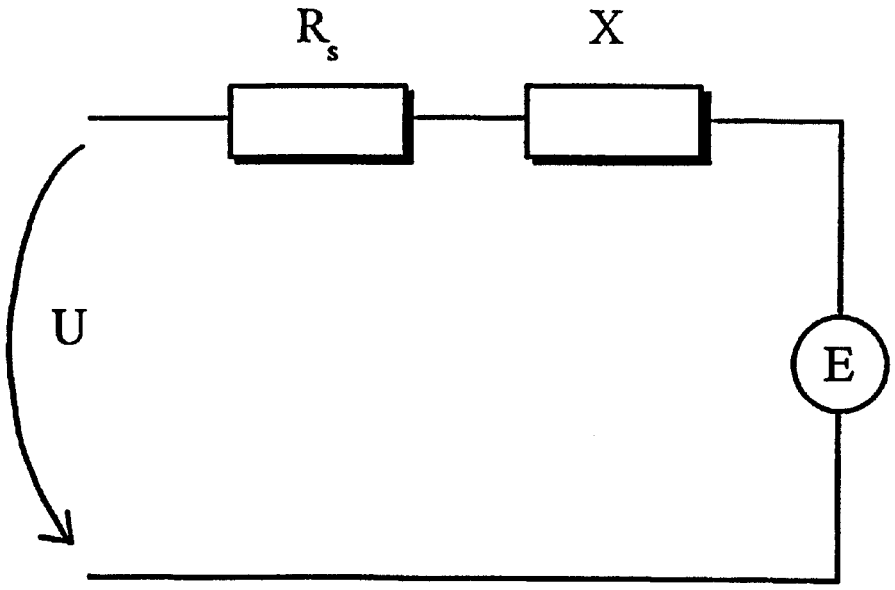
FIG. 2 presents an equivalent circuit representing a synchronous elevator motor.

A synchronous motor with permanent magnets can be described with sufficient accuracy by an equivalent circuit as shown in FIG. 2. The equivalent circuit consists of the electromotive force E, stator resistance $R_3$ and synchronous reactance X of the motor.

The stator resistance can be determined beforehand with a relatively high accuracy and stored in the memory of the computer 3 controlling the frequency converter 4. To determine the electromotive force and synchronous reactance, at least two additional measurements are needed.

With the elevator car installed in the elevator shaft, one of the measurements can be carried out using the normal braking resistance 7 at the motor terminals. When the brake 8 of the elevator is released, the elevator car will move at a constant speed. In this situation, the following equation applies:

$$I_1 = \frac{E_1}{R_s + R_j + i * X_1},$$

where $E_1=n_1*e$, $X_1=k*n_1*L$, n=speed of rotation and k=constant.

The other measurement can be carried out with the motor short-circuited, in which case the following equation applies:

$$I_2 = \frac{E_2}{R_s + i * X_2},$$

where $E_2=n_2*E$ and $X_2=k*n_2*L$.

From the data obtained by the method described above, it is possible to create a motor model that relatively accurately describes the newly installed system, allowing easy adjustment of the system.

For example, the motor power can be calculated from the electromotive force and the current component acting in the same direction. On the other hand, if the required torque is known, then the current needed to generate it can be calculated.

From the above-mentioned measurement results, it is also possible to calculate the friction of the diverting pulleys because the speed reached during the measurements depends on the friction. This makes it possible to change the control parameters so that the shaft properties, such as friction, are taken into account. The friction could be compensated, for example, by increasing the current reference.

In the foregoing, the invention has been described by way of example by referring to the attached drawings, but different embodiments of the invention are possible within the scope of the inventive idea defined by the claims.

What is claimed is:

1. A procedure for determining the parameters of an electric drive that controls a synchronous elevator motor having permanent magnets, so as to provide a computer controlling the operation of the electric drive with a control model describing the elevator and containing settable parameters, said procedure comprising:

allowing an elevator car, installed in an elevator shaft, to enter a motion condition resulting from a balance difference between elevator masses;

using two different loads connected to the terminals of the synchronous motor, measuring the rotational speed, electromotive force and synchronous reactance of the synchronous motor while the elevator car is in a constant motion condition;

determining stator resistance; and calculating a control model describing the elevator from the measurements of rotational speed, electromotive force, and synchronous reactance, and from the determined stator resistance.

2. The procedure as defined in claim 1, wherein one of the measurements is performed while the elevator car is in a constant motion condition, using the normal braking resistance at the motor terminals.

3. The procedure as defined in claim 1, wherein one of the measurements is carried out while the elevator car is in a constant motion condition, with the motor short-circuited.

4. The procedure as defined in claim 1, wherein the stator resistance is measured via a separate resistance measurement.

5. The procedure as defined in claim 1, wherein the rotational speed of the motor is measured using a tachometer.

6. The procedure as defined in claim 1, wherein the elevator motor receives a current component from the electric drive and motor power is calculated from the measured electromotive force and the current component.

7. The procedure as defined in claim 1, wherein the current needed to generate a desired torque is calculated from the measurement results.

8. The procedure as defined in claim 1, wherein diverting pulleys are located in the elevator shaft to assist movement of the elevator car, the elevator shaft and the diverting pulleys create friction against movement of the elevator car, and friction values of the elevator shaft and diverting pulleys are determined from the measurement results, and, based on such friction values a control parameter is adjusted to compensate for the friction.

9. The procedure as defined in claim 1, wherein the procedure is applied in conjunction with original installation of an elevator, elevator modernization, maintenance operations and/or when the elevator is being adapted to changed circumstances.

10. The procedure as defined in claim 1, wherein the parameters of the control model are set in the computer controlling the operation of the electric drive of the elevator.

11. The procedure as defined in claim 1, wherein the elevator masses include the elevator car and a counterweight.

* * * * *